US012065843B2

(12) United States Patent
Caruso

(10) Patent No.: US 12,065,843 B2
(45) Date of Patent: Aug. 20, 2024

(54) SYSTEMS FOR LEVELING TILES

(71) Applicant: Vincenzo Caruso, Clinton Township, MI (US)

(72) Inventor: Vincenzo Caruso, Clinton Township, MI (US)

( * ) Notice: Subject to any disclaimer, the term of this patent is extended or adjusted under 35 U.S.C. 154(b) by 0 days.

(21) Appl. No.: 17/948,802

(22) Filed: Sep. 20, 2022

(65) Prior Publication Data

US 2023/0091132 A1 Mar. 23, 2023

Related U.S. Application Data

(60) Provisional application No. 63/246,381, filed on Sep. 21, 2021.

(51) Int. Cl.
*E04F 21/22* (2006.01)

(52) U.S. Cl.
CPC ..... *E04F 21/22* (2013.01)

(58) Field of Classification Search
CPC ... E04F 21/1877; E04F 21/0092; E04F 21/20; E04F 21/22
See application file for complete search history.

(56) References Cited

U.S. PATENT DOCUMENTS

| | | | | |
|---|---|---|---|---|
| 9,279,259 | B1 * | 3/2016 | Russo | E04F 21/0092 |
| 10,801,218 | B2 * | 10/2020 | Cipriani | E04F 15/02022 |
| 2016/0369518 | A1 * | 12/2016 | Sarajian | E04F 15/08 |
| 2019/0242143 | A1 * | 8/2019 | Dahill | E04F 21/22 |
| 2019/0271167 | A1 * | 9/2019 | Ghelfi | E04F 21/0092 |
| 2019/0345724 | A1 * | 11/2019 | Sighinolfi | E04F 15/02022 |
| 2022/0372772 | A1 * | 11/2022 | Quesada Barbero | E04F 21/1877 |

FOREIGN PATENT DOCUMENTS

| | | | | |
|---|---|---|---|---|
| CA | 2909720 | A1 * | 12/2016 | E04F 15/08 |
| CA | 3040997 | A1 * | 11/2019 | E04F 15/02022 |
| EP | 2966239 | A1 * | 1/2016 | E04F 21/0092 |
| EP | 3421686 | A1 * | 1/2019 | E04F 21/0092 |
| EP | 3567183 | A1 * | 11/2019 | E04F 15/02022 |
| EP | 4008852 | A1 * | 6/2022 | E04F 21/0092 |
| WO | WO-2018172802 | A1 * | 9/2018 | |

OTHER PUBLICATIONS

Ridgid, LevelMax Lippage Reduction System Flat Stem (100-Pack), https://www.ridgid.com/us/en/ft3500, accessed Apr. 20, 2021.

* cited by examiner

*Primary Examiner* — Babajide A Demuren
(74) *Attorney, Agent, or Firm* — Dinsmore & Shohl LLP

(57) ABSTRACT

A tile leveling system includes a stem, a spinner, and an engaging member. The stem includes a base and a fork extending from the base. The fork includes a cylindrical portion extending in a direction opposite the base and having an externally threaded surface. A cutout is formed in the fork between the cylindrical portion and the base. The spinner includes a hub, a rim, and one or more spokes extending between the hub and the rim. An internally threaded surface defining a bore extends through the hub. The engaging member includes a main body and a mounting portion extending from the main body. A hub-receiving bore is formed in the main body for receiving the hub of the spinner and a stem-receiving bore is formed in the main body for receiving the cylindrical portion of the stem.

20 Claims, 5 Drawing Sheets

SYSTEMS FOR LEVELING TILES

CROSS-REFERENCE TO RELATED APPLICATION

This application claims the benefit of U.S. Provisional Patent Application No. 63/246,381, filed Sep. 21, 2022, which is hereby incorporated by reference in its entirety including the drawings.

TECHNICAL FIELD

The present specification generally relates to systems for leveling tiles and, more specifically, systems including engaging members for rotating leveling components to apply a force against a plurality of adjacent tiles to level the tiles.

BACKGROUND

During installation of tiles, adjacent tiles may be angled relative to a level surface, such that the adjacent tiles may not be leveled. Unleveled tiles provide an undesirable aesthetic. Tile leveling systems having a stem that is positioned below and between the tiles are known, such as the Level Max Tile Anti-Lippage and Spacing System sold by RIGID®. However, known tile leveling systems require a user to remove an exposed portion of the stem extending above the tiles by kicking the exposed portion, thereby increasing the steps and time required to level tile.

Accordingly, a need exists for a tile leveling system that levels tiles and removes the stem in one motion.

SUMMARY

In one embodiment, a tile leveling system includes: a stem including a base and a fork extending from the base, the fork including a cylindrical portion extending in a direction opposite the base and having an externally threaded surface, a cutout formed in the fork between the cylindrical portion and the base; a spinner including a hub, a rim, and one or more spokes extending between the hub and the rim, an internally threaded surface defining a bore extending through the hub; and an engaging member including a main body and a mounting portion extending from the main body, a hub-receiving bore formed in the main body for receiving the hub of the spinner, a stem-receiving bore formed in the main body for receiving the cylindrical portion of the stem.

In another embodiment, a tile leveling system includes: a stem including: a base; and a fork extending from the base, the fork including a cylindrical portion extending in a direction opposite the base and having an externally threaded surface, a cutout formed in the fork between the cylindrical portion and the base, the cutout defined by an outer edge of the fork, an inner horizontal edge extending from the outer edge, and an inner vertical edge extending from the inner horizontal edge, the inner horizontal edge and the inner vertical edge being perpendicular to one another, the inner horizontal edge being vertically offset from the base, the inner vertical edge extending perpendicular to an upper surface of the base.

In yet another embodiment, a method for leveling tiles includes: positioning a pair of adjacent tiles on an upper surface of a base of a stem, the stem including a fork extending from the upper surface of the base between abutting edges of the tiles and a cylindrical portion having an externally threaded surface extending from the fork in a direction opposite the base; positioning a spinner having an internally threaded surface and one or more spokes onto the stem such that the externally threaded surface of the cylindrical portion threadably engages the internally threaded surface of the spinner; positioning an engaging member having one or more slots on the spinner such that the one or more slots engage the one or more spokes of the spinner; and rotating the engaging member to cause the spinner to rotate and move toward the base of the stem and apply a compression force against an upper surface of the pair of adjacent tiles.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The tile leveling system generally includes a spinner, a stem, a spacer, and, in some embodiments, an engaging member. The stem may include a base that is positionable below two or more tiles, a fork that extends from the base to protrude from between the two or more tiles, and a threaded surface on a cylindrical portion of the fork. The spinner may include internal threads that engage the threaded surface of the stem, such that rotation of the spinner applies a compression force against the two or more tiles between the base of the stem and the spinner. The compression between the spinner and the stem levels the two or more tiles. The spacer may be coupled to the fork of the stem to provide a guide for positioning the two or more tiles. The engaging member may engage a portion of the spinner to rotate the spinner. The engaging member may include a mounting portion that may be engaged with a chuck on a drill such that the drill may rotate the engaging member.

Figure 1:
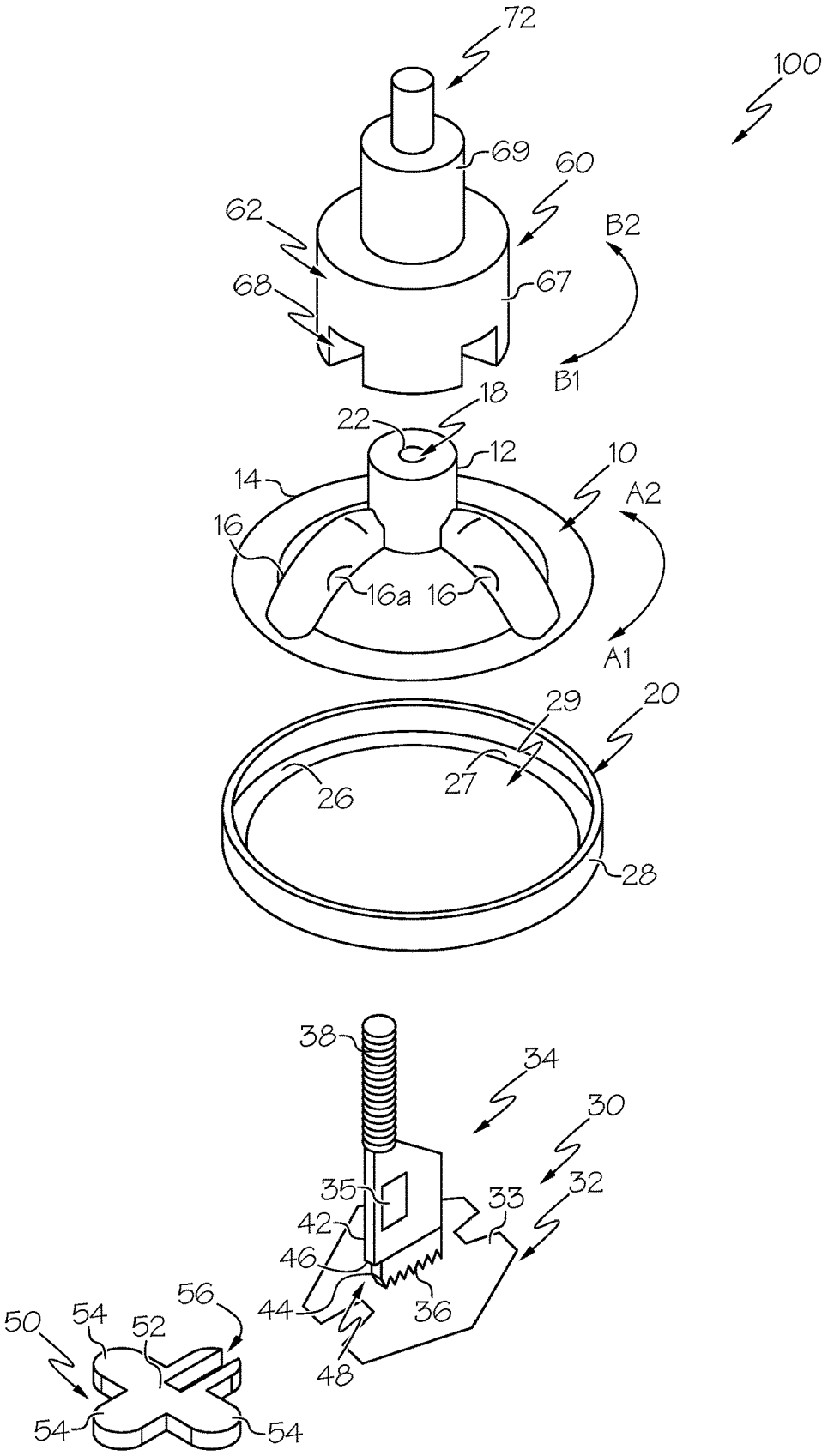
FIG. 1 schematically depicts an exploded view of a tile leveling system, according to one or more embodiments shown and described herein.

Referring now to FIG. 1, a tile leveling system 100 is depicted. The tile leveling system 100 may include a spinner 10, a cover 20, a stem 30, and a spacer 50. In embodiments, the tile leveling system 100 may further include an engaging member 60 for engaging the spinner 10. The above aspects of the tile leveling system 100 are used in conjunction to level adjacent tiles. The tile leveling system 100 may be used when installing tile on either a floor or a wall. Any of the above aspects may be used in conjunction with or separate from the rest of the above aspects.

Figure 2A:
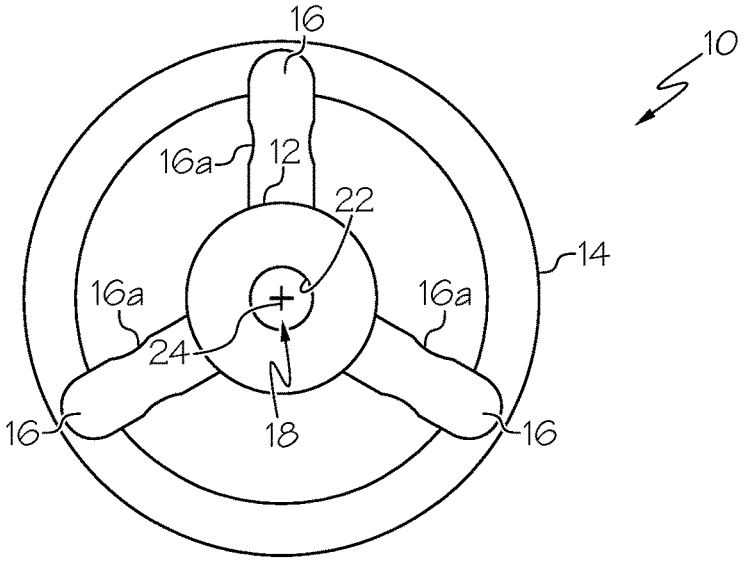
FIG. 2A schematically depicts a top view of a spinner of the tile leveling system of FIG. 1, according to one or more embodiments shown and described herein.
Figure 2B:
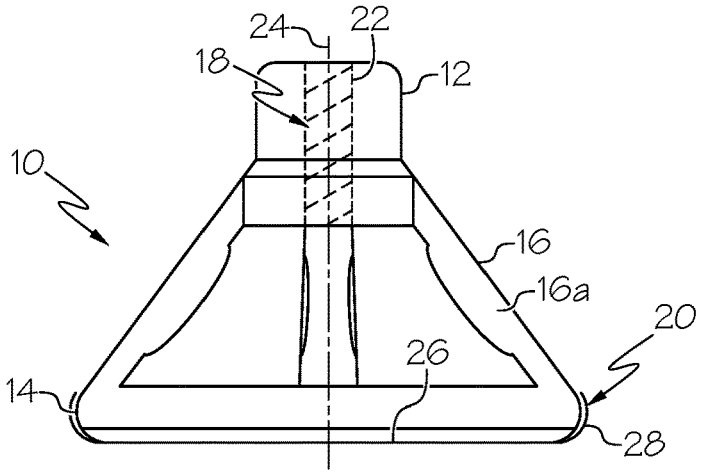
FIG. 2B schematically depicts a front view of the spinner of FIG. 2A, according to one or more embodiments shown and described herein.

Referring to FIGS. 1, 2A, and 2B, the spinner 10 may include a hub 12, a rim 14, and at least one spoke 16 extending between the hub 12 and the rim 14. The hub 12 may include an internally threaded surface 22 defining a bore 18 that extends through the hub 12. A central axis 24 may extend through and be defined by a center of the bore 18. The spinner 10 may include any number of spokes 16, such as one, two, three, four, or the like. Each spoke 16 may extend from the hub 12 at an angle oblique to the central axis 24. The at least one spoke 16 of the spinner 10 may include a contoured surface that complements a user's hand, allowing the user to grip and spin the spinner 10.

Accordingly, each spoke 16 may include indentations 16*a* on either side of the at least one spoke 16. The indentations 16*a* are configured to facilitate rotation of the spinner 10 by a user in the direction of arrow A1 and arrow A2. The indentations 16*a* may also include a surface texturing configured to increase a surface friction between the indentation 16*a* and the user's hand. For example, the indentations 16*a* are configured to receive a thumb or finger of a user. The rim 14 may include a diameter that is larger than a diameter of the hub 12. As shown in FIGS. 1 and 2A, the rim 14 has a circular shape. However, it should be appreciated that the rim 14 may have any suitable shape such as, for example, triangular, square, hexagonal, or the like.

As shown in FIG. 1, the cover 20 has a circular shape to correspond to the circular shape of the rim 14. However, it should be appreciated that the cover 20 may have any suitable shape such as, for example, triangular, square, hexagonal, or the like, such that the shape of the cover 20 corresponds to the shape of the rim 14 of the spinner 10. The cover 20 may include a lower surface 26 and a sidewall 28 extending at least substantially perpendicular to and from the lower surface 26. The sidewall 28 of the cover 20 has an inner diameter that is equal to or larger than an outer diameter of the rim 14 of the spinner 10. The cover 20 may include an opening 29 extending through the lower surface 26, the opening 29 being defined by an inner diameter of the lower surface 26. As such, the lower surface 26 defines a lip 27 on which the spinner 10 may be seated, as discussed in more detail herein.

Figure 2C:
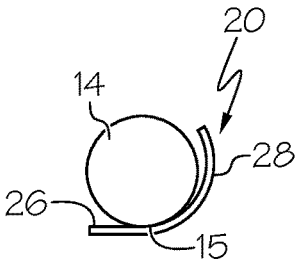
FIG. 2C schematically depicts a cross section view of an embodiment of the spinner of FIG. 2A engaging an embodiment of a cover, according to one or more embodiments shown and described herein.
Figure 2D:
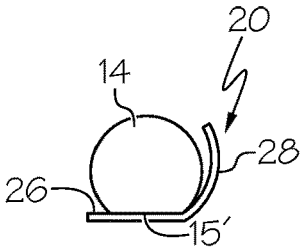
FIG. 2D schematically depicts a cross section view of an embodiment of the spinner of FIG. 2A engaging an embodiment of the cover of FIG. 2C, according to one or more embodiments shown and described herein.

As shown in FIG. 2B, the cover 20 is shown fitted around the rim 14 of the spinner 10. The lower surface 26 of the cover 20 may contact a bottom of the rim 14 of the spinner 10 and the sidewall 28 of the cover 20 may extend around an outer perimeter of the rim 14. The rim 14 of the spinner 10 may be press fit into the cover 20 to removably couple the spinner 10 to the cover 20. The cover 20 is configured to snap onto the rim 14 and be retained by a friction fit. Accordingly, the rim 14 of the spinner 10 may have a rounded bottom surface or a flat bottom surface and the lower surface 26 and the sidewall 28 of the cover 20 may have a shape corresponding to that of the rim 14. As a non-limiting example, as shown in FIG. 2C, in embodiments, the rim 14 of the spinner 10 may have a bottom surface 15 that is rounded and corresponds to the lower surface 26 of cover 20, which may also be rounded. As another non-limiting example, as shown in FIG. 2D, in embodiments, the rim 14 of the spinner 10 may have a bottom surface 15' that is flat and corresponds to the lower surface 26 of cover 20, which may also be flat.

Figure 3A:
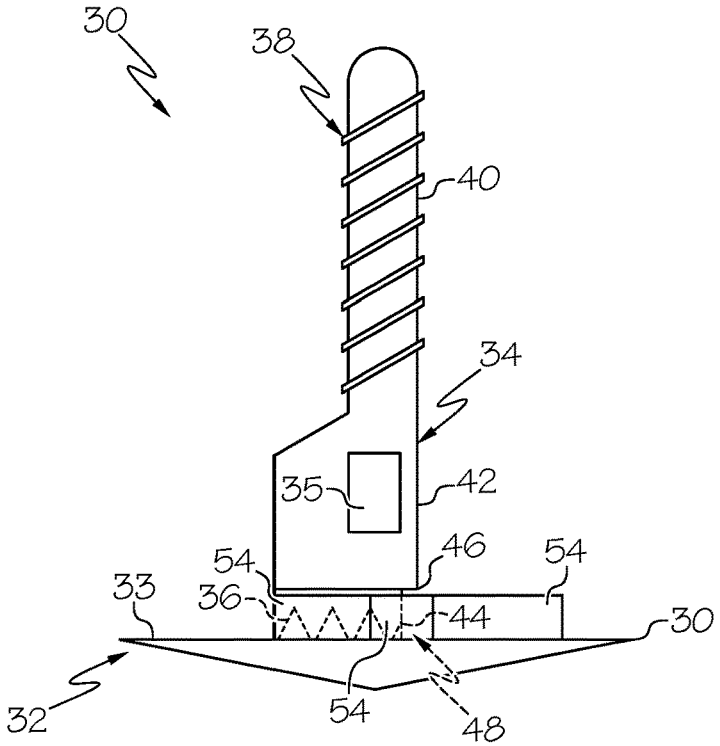
FIG. 3A schematically depicts a front view of a stem of the tile leveling system of FIG. 1 engaged with a spacer, according to one or more embodiments shown and described herein.

Referring to FIGS. 1 and 3A, the stem 30 may include a base 32 and a fork 34 extending from the base 32. The fork 34 may include a plurality of prongs 36, a cylindrical portion 38, an outer edge 42, an inner vertical edge 44, and an inner horizontal edge 46. The base 32 may include an upper surface 33. The prongs 36 of the fork 34 may be coupled to the upper surface 33 of the base 32. In embodiments, the prongs 36 may be either triangular or semicircular. A space between the prongs 36 and the base 32 may define a plurality of perforations that are configured to reduce an amount of force required to separate the fork 34 from the base 32. The inner vertical edge 44 may be recessed radially inwardly from the outer edge 42. As such, a cutout 48 may be defined by the upper surface 33 of the base 32, the inner vertical edge 44, and the inner horizontal edge 46. In embodiments, the inner horizontal edge 46 and the inner vertical edge 44 are perpendicular to one another. The inner horizontal edge 46 is vertically offset from the upper surface 33 of the base 32.

Figure 3B:
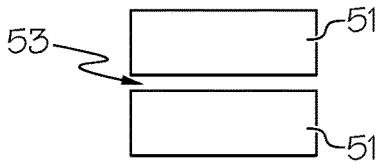
FIG. 3B schematically depicts a top view of a tile configuration including a pair of tiles, according to one or more embodiments shown and described herein.

The cylindrical portion 38 of the fork 34 may extend in a direction opposite from and substantially perpendicular to a horizontal plane of the upper surface 33 of the base 32. The cylindrical portion 38 may include an externally threaded surface 40 configured to threadably engage the internally threaded surface 22 of the hub 12. The stem 30 may include a pair of integrally formed side spacers 35 that extend in an oblique direction from the sides of the fork 34 and to the upper surface 33 of the base 32. The side spacers 35 provide a gap to be formed between edges of adjacent tiles positioned on the base 32 of the stem 30 and on opposite sides of the side spacers 35. The width of the gap is defined by a distance between opposite ends of the side spacers 35 at the upper surface 33 of the base 32. Accordingly, it should be appreciated that the stem 30 may be positionable within an abutting portion of a pair of adjacent tiles to space the pair of tiles apart from one another such as, for example, the tile configuration depicted in FIG. 3B illustrating a pair of tiles 51 and an abutting portion 53.

Figure 4A:
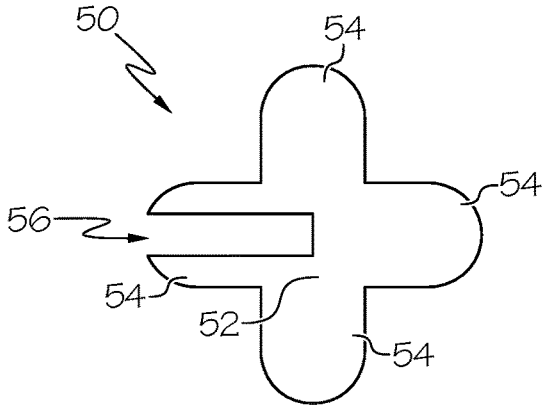
FIG. 4A schematically depicts a top view of a first embodiment of a spacer, according to one or more embodiments shown and described herein FIG. 4B schematically depicts a top view of the stem of FIG. 3A including the spacer of FIG. 3B, according to one or more embodiments shown and described herein.

Referring to FIGS. 1 and 4A, the spacer 50 may include a central portion 52 and a plurality of tabs 54 extending in radial directions from the central portion 52. In embodiments, the spacer 50 may include four tabs 54 extending from the central portion 52 at about 90° from the adjacent tab 54. In embodiments, the tabs 54 may extend from the central portion 52 at an angle oblique to a direction of extension of the other tabs 54. A slot 56 is formed in and extends through one of the tabs 54 and at least partially though the central portion 52 of the spacer 50. As discussed in more detail herein, and as shown in FIG. 3A, the spacer 50 has a thickness less than a height of the inner vertical edge 44 of the fork 34 defining the cutout 48. Additionally, the slot 56 may include a width that is about equal to or greater than a width of the fork 34 such that the spacer 50 may be press fit onto the fork 34 of the stem 30 by pressing the fork 34 into the slot 56 such that the slot 56 mates with the cutout 48. The central portion 52 of the spacer 50 is positioned axially between the cylindrical portion 38 and the base 32 when the spacer 50 is engaged with the stem 30.

Figure 4B:
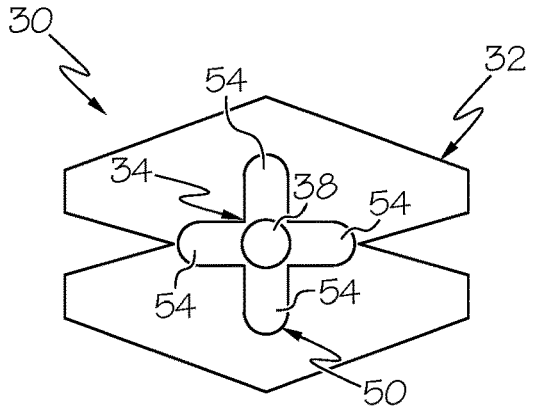
FIG. 4C schematically depicts a top view of a tile configuration including two pairs of tiles, according to one or more embodiments shown and described herein.
Figure 4C:
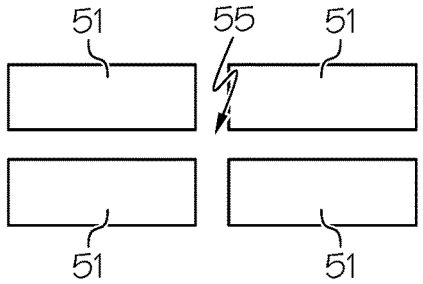

Referring now to FIG. 4B, a top view of the stem 30 is illustrated with the spacer 50 coupled to the fork 34 of the stem 30. The plurality of tabs 54 may extend radially away from the fork 34. The spacer 50 is configured to act as a guide for positioning tiles around the stem 30. Specifically, tiles may be positioned such that the tabs 54 contact opposite edges of adjacent tiles, and a corner of each tile is positioned between two adjacent tabs 54. As such, the spacer 50 allows for the stem 30 to be accurately placed at an intersection between each of two pairs of adjacent tiles such as, for example, the tile configuration depicted in FIG. 4C including a plurality of tiles 51, specifically four tiles 51, defining an intersection 55 of the four tiles 51 at which the spacer 50 is positioned.

Figure 5A:
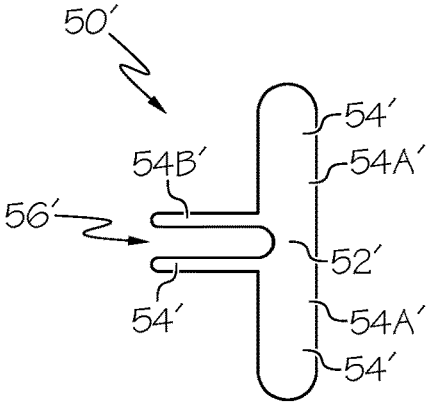
FIG. 5A schematically depicts a top view of a second embodiment of a spacer, according to one or more embodiments shown and described herein.
Figure 5B:
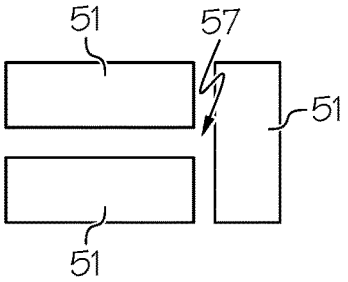
FIG. 5B schematically depicts a top view of a tile configuration including three adjacent tiles, according to one or more embodiments shown and described herein.

Referring to FIG. 5A, an alternative embodiment of the spacer 50 is depicted. The spacer 50' may include three tabs 54' extending from a central portion 52'. Specifically, the tabs 54' include a pair of tabs 54A', i.e., a first tab 54A' and a second tab 54A', extending in opposite radial directions away from the central portion 52' and a third tab 54B' extending in a radial direction away from the central portion 52' between and perpendicular to the pair of tabs 54A'. A slot 56' is formed in the third tab 54B' and extends toward the central portion 52'. The spacer 50' may be used when leveling three tiles that are adjacent to one another and the tile leveling system 100 positioned therebetween. The spacer 50' allows for the stem 30 to be accurately placed between a pair of adjacent tiles and at an abutting edge of another tile. For example, the tile configuration depicted in FIG. 5B includes a plurality of tiles 51, specifically three tiles 51 and the spacer 50' may positioned at an intersecting and abutting portion 57 of the tiles 51.

Figure 6A:
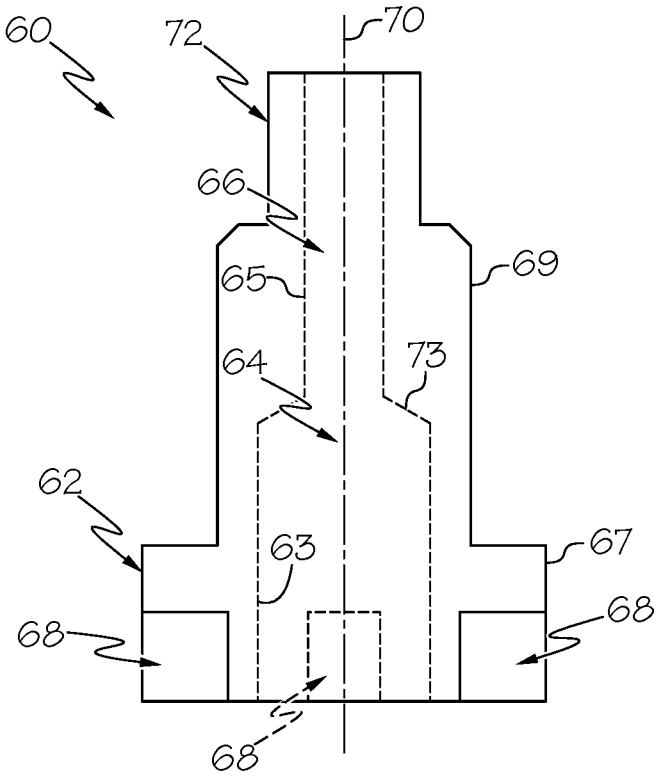
FIG. 6A schematically depicts a front view of an engaging member of the tile leveling system of FIG. 1, according to one or more embodiments shown and described herein.

Referring now to FIGS. 1 and 6A, the engaging member 60 may include a main body 62, a first internal surface 63 defining a hub-receiving bore 64 that extends at least partially through the main body 62, a second internal surface 65 defining a stem-receiving bore 66 that extends at least partially through the main body 62 and is in communication with the hub-receiving bore 64, a central axis 70 circumferentially surrounded by the first internal surface 63 and second internal surface 65, at least one slot 68 extending perpendicularly to the central axis 70 through the first internal surface 63, and a mounting portion 72 extending from the main body 62. The first internal surface 63 has an inner diameter greater than an inner diameter of the second internal surface 65. In embodiments, the engaging member 60 includes a tapered surface 73 extending from the first internal surface 63 to the second internal surface 65.

In embodiments, the main body 62 has a first main body portion 67 and a second main body portion 69 extending between the first main body portion 67 and the mounting portion 72. In this embodiment, the slots 68 are formed within the first main body portion 67. Specifically, the slots 68 extend from an outer surface of the first main body portion 67 to the hub-receiving bore 64. Additionally, the hub-receiving bore 64 extends through the first main body portion 67 and partially though the second main body portion 69, and the stem-receiving bore 66 extends partially though the second main body portion 69 and the mounting portion 72. The mounting portion 72 may be configured to be received within and engage a chuck of a drill, allowing the engaging member 60 to be rotated in the direction of arrow B1 and arrow B2 (FIG. 1) as the drill is operated.

In embodiments, the mounting portion 72 may include a diameter that is larger than the diameter of the main body 62 to allow a user to rotate the engaging member 60 by hand, without a drill. In embodiments, the first main body portion 67 has an outer diameter greater than an outer diameter of the second main body portion 69. Additionally, the outer diameter of the second main body portion 69 is greater than an outer diameter of the mounting portion 72. However, in embodiments, it should be appreciated that the outer diameter of the first main body portion 67 may be equal to the outer diameter of the second main body portion 69. In other embodiments, it should be appreciated that the outer diameter of the first main body portion 67 may be less than the outer diameter of the second main body portion 69.

The number of slots 68 formed in the main body 62 correspond to the number of spokes 16 on the spinner 10. Accordingly, if the spinner 10 includes three spokes 16, the main body 62 similarly includes three slots 68 formed therein and extending through the first internal surface 63. The slots 68 may be sized and shaped to receive the spokes 16 of the spinner 10.

Figure 6B:
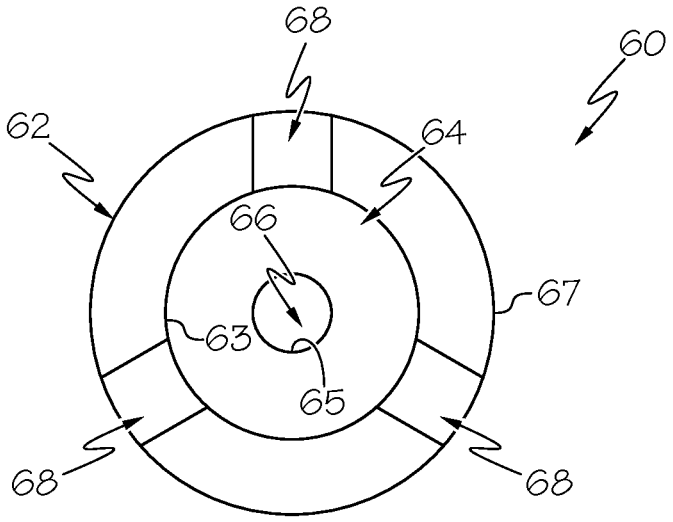
FIG. 6B schematically depicts a bottom view of the engaging member of FIG. 6A, according to one or more embodiments shown and described herein.

Referring to FIG. 6B, a bottom view of the engaging member 60 is illustrated and, in embodiments, includes plurality of slots 68 equidistantly spaced apart from one another along an outer perimeter of the main body 62. The slots 68 may extend through the main body 62 from the hub-receiving bore 64 at an angle. An angle between a slot 68 and an adjacent slot 68 may be the same as an angle between the slot 68 and another adjacent slot 68. For example, in embodiments including three slots 68, the slots 68 may extend at an angle from one another that is about 120°.

The operation of the tile leveling system 100 will now be described with reference to FIGS. 1-6B. The spacer 50 may be placed on the stem 30 by positioning the fork 34 within the slot 56 of the spacer 50. The spacer 50 may be press fit onto the stem 30 to maintain the fork 34 within the slot 56. The cutout 48 in the stem 30 allows the tabs 54 of the spacer 50 to extend away from the stem 30 at a position close to a center of the stem 30, thereby positioning the cylindrical portion 38 between each of the tiles, as described below. The stem 30 may be placed at a location where tiles are to be laid. Two or more tiles may be laid about the stem 30 on top of the base 32 of the stem 30. The corners of each of the tiles may be positioned between the tabs 54 of the spacer 50, such that the tabs 54 align the tiles about the stem 30, and the cylindrical portion 38 extends from a location between each of the corners of the tiles, or abutting edges in situations in which the spacer 50' is used instead of the spacer 50.

Once the stem 30 is positioned between the tiles, the spinner 10 may be coupled to stem 30. Specifically, the spinner 10 may be lowered onto the cylindrical portion 38 of the stem 30 such that the cylindrical portion 38 extends into the bore 18 of the hub 12. The internally threaded surface 22 of the hub 12 may threadably engage the externally threaded surface 40 of the cylindrical portion 38 such that rotation of the spinner 10 in the direction of arrow A1 (FIG. 1) moves the spinner 10 toward the base 32 of the stem 30.

The engaging member 60 may then be lowered onto the spinner 10 to engage the spinner 10. Specifically, the spokes 16 of the spinner 10 may be positioned within the slots 68 of the engaging member 60 such that rotation of the engaging member 60 in the direction of arrow B1 and arrow B2 (FIG. 1) rotates the spinner 10 through contact between the main body 62 of the engaging member 60 and the spokes 16 of the spinner 10. The mounting portion 72 of the engaging member 60 may be inserted into and coupled to a chuck of a drill, allowing the spinner 10 to be rotated by the drill. Alternatively, the engaging member 60 may be manually rotated by hand or some other suitable tool.

As the spinner 10 rotates and translates vertically toward the base 32 of the stem 30 along the cylindrical portion 38 of the stem 30, the rim 14 of the spinner 10 contacts an upper surface of the tiles while the base 32 contacts a lower surface of the tiles. Further rotation of the spinner 10 in the direction of arrow A1 (FIG. 1) results in compression between the upper surface and the lower surface of the adjacent tiles between the spinner 10 and the base 32 of the stem 30. Compression from the spinner 10 and the stem 30 aligns the tiles by adjusting a height of each of the corners of the tiles to a position between the spinner 10 and the stem 30. The cover 20 encloses the rim 14 of the spinner 10 to prevent direct contact between the spinner 10 and the tiles. The cover 20 provides a softer, more deformable surface for contacting the tiles, thereby preventing scratching of the tiles during rotation of the spinner 10.

Once the tiles are aligned between the spinner 10 and the base 32 of the stem 30, the tile leveling system 100 may be removed from between the tiles by deforming the prongs 36 of the fork 34, and separating the fork 34 from the base 32 of the stem 30. The prongs 36 may be deformed through a shear force. For example, the prongs 36 may be separated from the base 32 by applying a force in a direction parallel to the upper surface 33 of the base 32. By applying a force in this direction, the prongs 36 may be sheared, thus separating the cylindrical portion 38 of the stem 30, the spinner 10, the cover 20, and the engaging member 60 from the rest of the tile leveling system 100, i.e., the base 32 of the stem 30.

The tile leveling system 100 may alternatively or additionally be removed from between the tiles by separating the prongs 36 of the fork 34 from the base 32 through tensile force. Once the tiles are aligned, the spinner 10 may continually be rotated. Further rotation of the spinner 10 in the direction of arrow A1 (FIG. 1) causes deformation of the prongs 36 of the fork 34 by pulling the fork 34 away from the base 32 of the stem 30, and separating the fork 34 from the base 32.

As stated above, any of the above aspects may be used in conjunction with or separate from the rest of the above aspects. For example, the tile leveling system 100 may be used without the engaging member 60. Without the engaging member 60, the spinner 10 may be rotated by hand. In addition, the tile leveling system 100 may not include the cover 20. Further, each of the above aspects may be used in conjunction with an external tile leveling system. For example, the engaging member 60 may be adapted for use with an external tile leveling system by altering the sizing and number of slots 68 formed in the main body 62.

It is noted that the term "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A tile leveling system comprising:

a stem including a base and a fork extending from the base, the fork including a cylindrical portion extending in a direction opposite the base and having an externally threaded surface, a cutout formed in the fork between the cylindrical portion and the base;

a spinner including a hub, a rim, and one or more spokes extending between the hub and the rim, an internally threaded surface defining a bore extending through the hub; and an engaging member including a main body and a mounting portion extending from the main body, a hub-receiving bore formed in the main body for receiving the hub of the spinner, a stem-receiving bore formed in the main body for receiving the cylindrical portion of the stem.

2. The tile leveling system of claim 1, wherein one or more slots are formed in the main body of the engaging member, the one or more slots extending from an outer surface of the main body to the hub-receiving bore.

3. The tile leveling system of claim 2, wherein the spinner includes a plurality of spokes extending between the hub and the rim.

4. The tile leveling system of claim 3, wherein the one or more slots comprises a plurality of slots, each slot of the plurality of slots configured to receive a corresponding spoke of the plurality of spokes when the engaging member is lowered onto the spinner.

5. The tile leveling system of claim 1, wherein the hub-receiving bore has an inner diameter greater than an inner diameter of the stem-receiving bore.

6. The tile leveling system of claim 5, wherein the mounting portion extends from the main body along a central axis, the main body having an outer diameter greater than an outer diameter of the mounting portion.

7. The tile leveling system of claim 1, further comprising a cover including a lower surface and a sidewall, an opening formed within the lower surface, the rim of the spinner received within the cover and seated on the lower surface of the cover.

8. A tile leveling system comprising:

a stem comprising:

a base; and a fork extending from the base, the fork including a cylindrical portion extending in a direction opposite the base and having an externally threaded surface, a cutout formed in the fork between the cylindrical portion and the base, the cutout defined by an inner horizontal edge, an inner vertical edge, and an upper surface of the base, the inner horizontal edge extending between an outer edge of the fork and the inner vertical edge, the inner vertical edge extending between the inner horizontal edge and the upper surface of the base, the cutout having an open end on a side opposite the inner vertical edge, the inner horizontal edge and the inner vertical edge being perpendicular to one another, the inner horizontal edge being vertically offset from the base, the inner vertical edge extending perpendicular to the upper surface of the base.

9. The tile leveling system of claim 8, further comprising:

a spacer comprising:

a central portion; and a plurality of tabs extending radially from the central portion, a slot formed in one of the tabs of the plurality of tabs and extending toward the central portion.

10. The tile leveling system of claim 9, wherein the spacer has a thickness less than a height of the inner vertical edge of the fork, and the slot has a width at least equal to a width of the fork.

11. The tile leveling system of claim 10, wherein the spacer includes a first tab and a second tab extending in opposite radial directions from the central portion, and a third tab extending between and perpendicular to the first tab and the second tab in a radial direction from the central portion, the slot formed in the third tab.

12. The tile leveling system of claim 10, wherein the spacer includes four tabs, a first pair of tabs of the four tabs extending in opposite radial directions, and a second pair of tabs of the four tabs extending in opposite radial directions, the first pair of tabs extending in directions perpendicular to the second pair of tabs.

13. The tile leveling system of claim 9, wherein the central portion of the spacer is positioned axially between the cylindrical portion and the base when the spacer is engaged with the stem.

14. A method for leveling tiles, the method comprising:

positioning a pair of adjacent tiles on an upper surface of a base of a stem, the stem including a fork extending from the upper surface of the base between abutting edges of the tiles and a cylindrical portion having an externally threaded surface extending from the fork in a direction opposite the base;

positioning a spinner having an internally threaded surface and one or more spokes onto the stem such that the externally threaded surface of the cylindrical portion threadably engages the internally threaded surface of the spinner;

positioning an engaging member having one or more slots on the spinner such that the one or more slots engage the one or more spokes of the spinner; and rotating the engaging member to cause the spinner to rotate and move toward the base of the stem and apply a compression force against an upper surface of the pair of adjacent tiles.

15. The method of claim 14, wherein the compression force applied against the upper surface of the pair of adjacent tiles causes the pair of adjacent tiles to become level within one another.

16. The method of claim 14, wherein the engaging member comprises:

a main body, a hub-receiving bore and a stem-receiving bore formed in the main body, the one or more slots formed in the main body and extending from an outer surface of the main body to the hub-receiving bore; and a mounting portion extending from the main body along a central axis.

17. The method of claim 16, wherein the main body comprises a first main body portion and a second main body portion, the second main body portion extending between the first main body portion and the mounting portion, the first main body portion having an outer diameter greater than an outer diameter of the second main body portion.

18. The method of claim 14, wherein the one or more slots comprises a plurality of slots equidistantly spaced apart from one another.

19. The method of claim 14, further comprising positioning a cover between the spinner and the upper surface of the pair of adjacent tiles.

20. The method of claim 19, wherein the cover includes a lower surface and a sidewall, an opening formed within the lower surface, a rim of the spinner received within the cover and seated on the lower surface of the cover.

* * * * *